United States Patent [19]

Smith

[11] 4,231,499

[45] Nov. 4, 1980

[54] HANGER WITH COLLAPSIBLE ARMS PROVIDED WITH A RELEASE AND LOCKING MECHANISM

[76] Inventor: Peter Smith, Via San Godenzo 16, 00189 Roma, Italy

[21] Appl. No.: 889,008

[22] Filed: Mar. 22, 1978

[30] Foreign Application Priority Data

Aug. 4, 1977 [IT] Italy ..... 50565 A/77
Dec. 1, 1977 [IT] Italy ..... 52031 A/77

[51] Int. Cl.[2] ..... A47J 51/10
[52] U.S. Cl. ..... 223/94
[58] Field of Search ..... 223/94, 98, 89, 93

[56] References Cited

U.S. PATENT DOCUMENTS 3,802,610 4/1974 Love et al. ..... 223/94

FOREIGN PATENT DOCUMENTS 704711 4/1966 Italy ..... 223/94

*Primary Examiner*—George H. Krizmanich
*Attorney, Agent, or Firm*—Schwartz, Jeffery, Schwaab, Mack, Blumenthal & Koch

[57] ABSTRACT

A collapsible garment hanger includes a pair of arms pivoted on a mounting block, the arms pivoting downwardly to permit a garment to drop therefrom. A spring operated release and lever mechanism with a bell-crank controls the release.

1 Claim, 14 Drawing Figures

HANGER WITH COLLAPSIBLE ARMS PROVIDED WITH A RELEASE AND LOCKING MECHANISM

This invention relates to a hanger with collapsible arms provided with a release and locking mechanism.

A hanger of this type is particularly useful where a garment has to be removed easily and quickly from a hanger hung on a rod high above floor level as, for example, in dressmakers' or tailors' shops where the hangers are usually hung on two rods supported at two different levels, one above the other.

In this case, it is inconvenient to take the garments down from the hangers hung on the upper rod, particularly in the presence of the customer who has to try them on, due to the undesirable waste of time involved.

On the contrary, the hanger according to the invention comprises two collapsible arms, pivoted together at one end, so as to take two different positions, that is an extended raised position, where they support the garment and a folding or downward swinging position in which the garment is allowed to slide off the hanger by gravity.

The two arms are normally held and locked in the extended, raised position in which they support the garment by means of a spring-operated mechanism. On the release of the spring-operated locking mechanism, the two arms swing downwardly, under the weight of the garment, to the folded position allowing the garment to slide off them. The spring-operated mechanism can be suitably actuated by means of a cord of such a length as to be readily at hand.

Thus, in order to take a garment off the hanger, placed high from the floor, it is sufficient to pull the relevant cord actuating the spring-operated mechanism and causing the arms to swing downwards to the folded position. When the garment has slid off the arms, the spring-operated mechanism automatically returns the arms to the extended, raised position, the hanger being then ready for re-use.

The invention will be now described in detail with reference to the annexed drawings, wherein five embodiments of hanger are illustrated.

Figure 1:
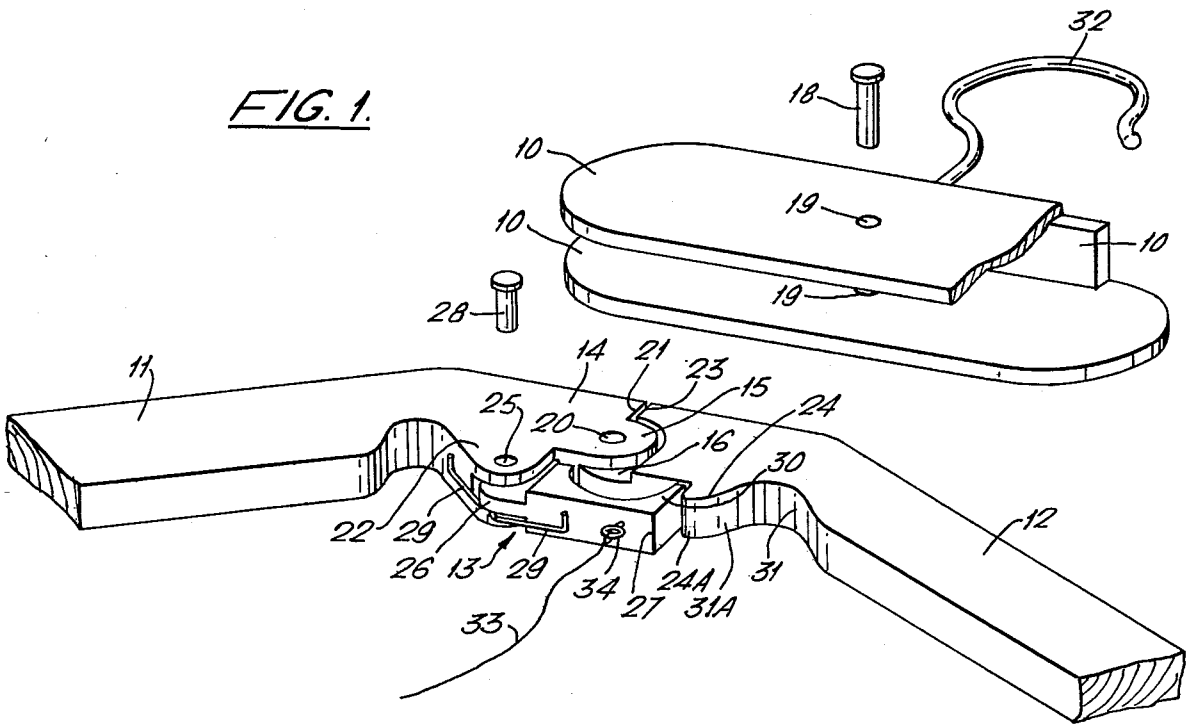
FIG. 1 is an exploded perspective view of the hanger with collapsible arms.

Referring specifically to FIG. 1, the hanger according to the invention consists essentially of a slotted block 10, two collapsible arms 11 and 12, one pivoted on the other, and a spring-operated lever mechanism 13.

The rounded inner end 14 of arm 11 is grooved and, since the inner end 16 of the other arm 12 is slightly thinner than the width of the aforesaid groove it fits freely into the former. The two arms 11 and 12 are pivoted together as well as to the slotted supporting block 10, by means of pin 18 which passes through hole 19 in the slotted supporting block 10 and through hole 20 in the two arms 11 and 12.

The end 14 of the arm 11 has an upper step 21 and a lower curved protruding part 22, while the thinner end 16 of arm 12 has an upper forward step 23 and a lower rearward step 24.

The lower protruding part 22 of arm 11 is also grooved and a hole 25 is drilled through the same. The thinner shaped end 26 of lever 27 of the release and locking mechanism 13 is fitted into this groove, this thinner shaped end being drilled in correspondence with hole 25 in protruding part 22 of arm 11.

A coiled-wire torsion spring 29, operating between protruding part 22 and lever 27, is mounted on pin 28 to exert pressure in a counter-clockwise direction as shown in the figure.

Lever 27 has a tooth-shaped free end 30, while arm 12 has a lower notch 31 shaped in such a way as to engage with tooth 30, as will be described hereinbelow.

The hanger according to the invention further comprises a hook 32 mounted on a slotted supporting block 10 and a cord 33, one end of which is attached to eyelet 34 fixed to lever 27.

Figure 2:
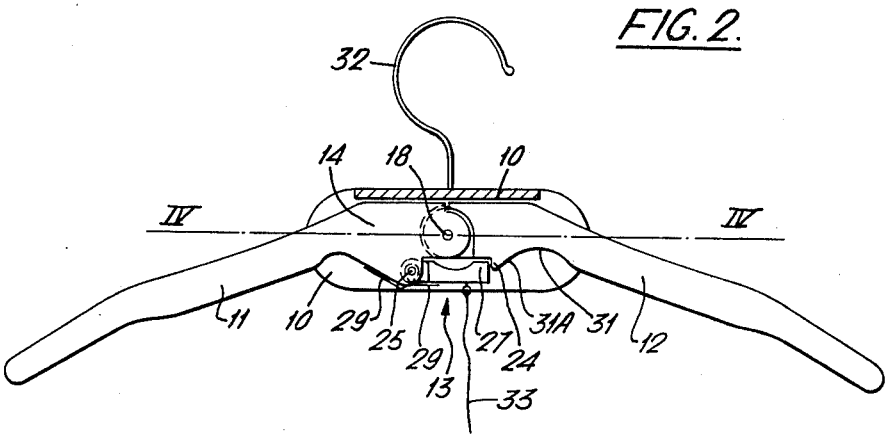
FIG. 2 is a side elevation view, with parts cut away, of the hanger in the extended condition.

With such an arrangement of the parts, lever 27 acts between protruding part 22 through pin 28 and step 24 to lock arms 11 and 12 in the extended position shown in FIG. 2. The extended hanger locked in this way can thus support the weight of the garment (not shown) hung thereon.

Figure 3:
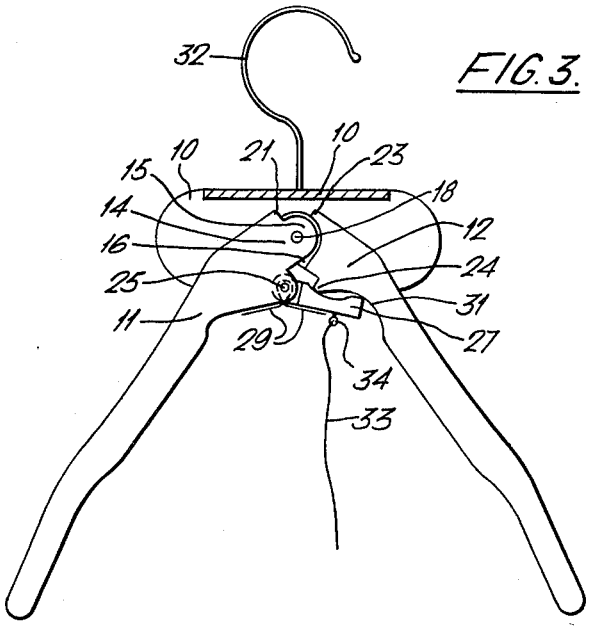
FIG. 3 is a similar view of the hanger in the folded condition.

On the contrary, on cord 33 being pulled, lever 27 will rotate downwards in a clockwise direction and disengage from step 24, thus unlocking arms 11 and 12 which, under the weight of the garment, will swing down to the position shown in FIG. 3, allowing the garment to slide off.

Once the garment is clear of the hanger, lever 27 will swing upwards in a counter-clockwise direction under the action of coil spring 29 and, due to the action of tooth 30 against the notch shaped under surface 31, this lever will force arms 11 and 12 to turn about pin 18 and rise to the extended position as shown in FIG. 2.

With regard to the action of lever 27, in restoring the hanger to the extended position, the function of surface 31A of the lower surface of notch 31, against which tooth 30 of lever 27 presses, is of decisive importance. The angle formed by surface 31A and the axis of arm 12 of the hanger must fall within a well-defined range, in order to enable the hanger to automatically return to the extended position under the action of lever 27.

It has been found that a good return action is obtained with angles in the range from 25° to 50°, furthermore this return action is facilitated by the relevant bevelling 24A of tooth 24.

Figure 4:
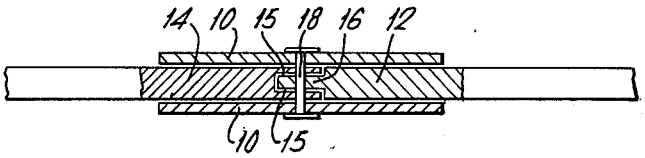
FIG. 4 is a sectional view along line IV—IV of FIG. 2.
Figure 5:
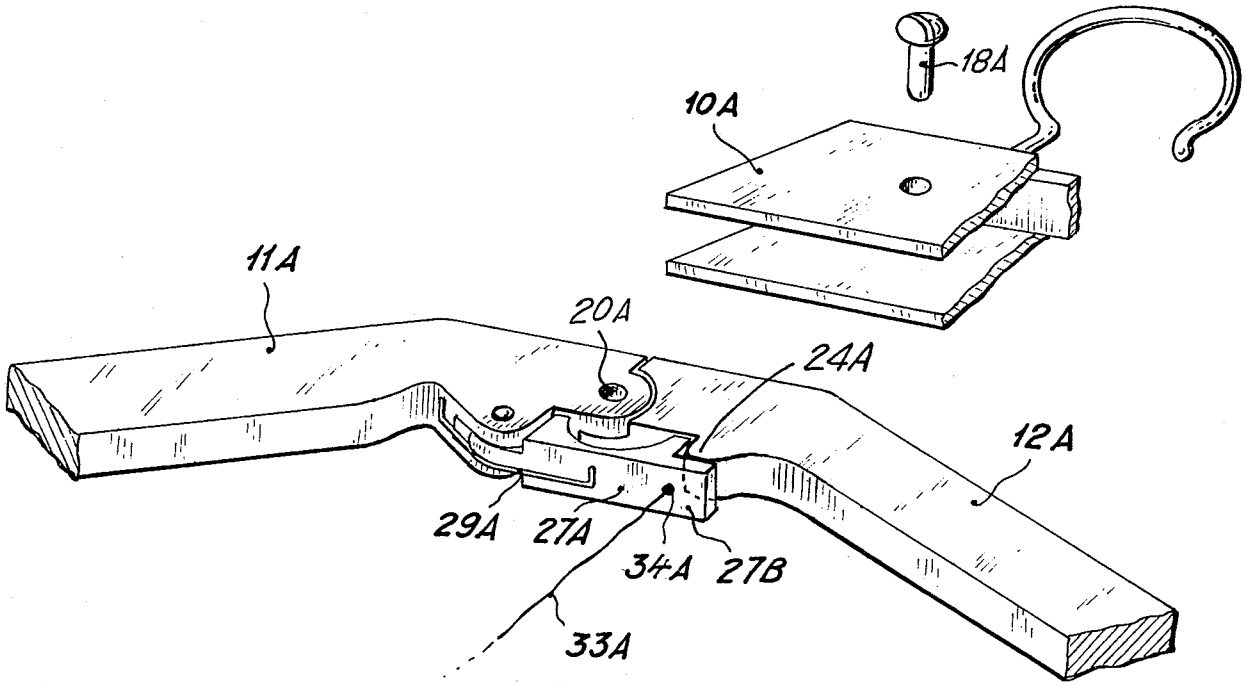
FIG. 5 is an exploded perspective view, with parts cut away or omitted, of a second embodiment of the invention.

Referring to FIG. 5, in this embodiment lever member 27 of FIG. 4, here indicated with reference 27A, is provided with an extension 27B below tooth 24A of arm 12A.

This extension increases the length of the lever arm for the anchoring point 34A of cord 33A and, accordingly, the force to be applied to the cord for lowering lever member 27A is reduced. It is evident that there are no other modifications either of parts or of operation in respect to the mechanism of the hanger described and illustrated above.

Figure 6:
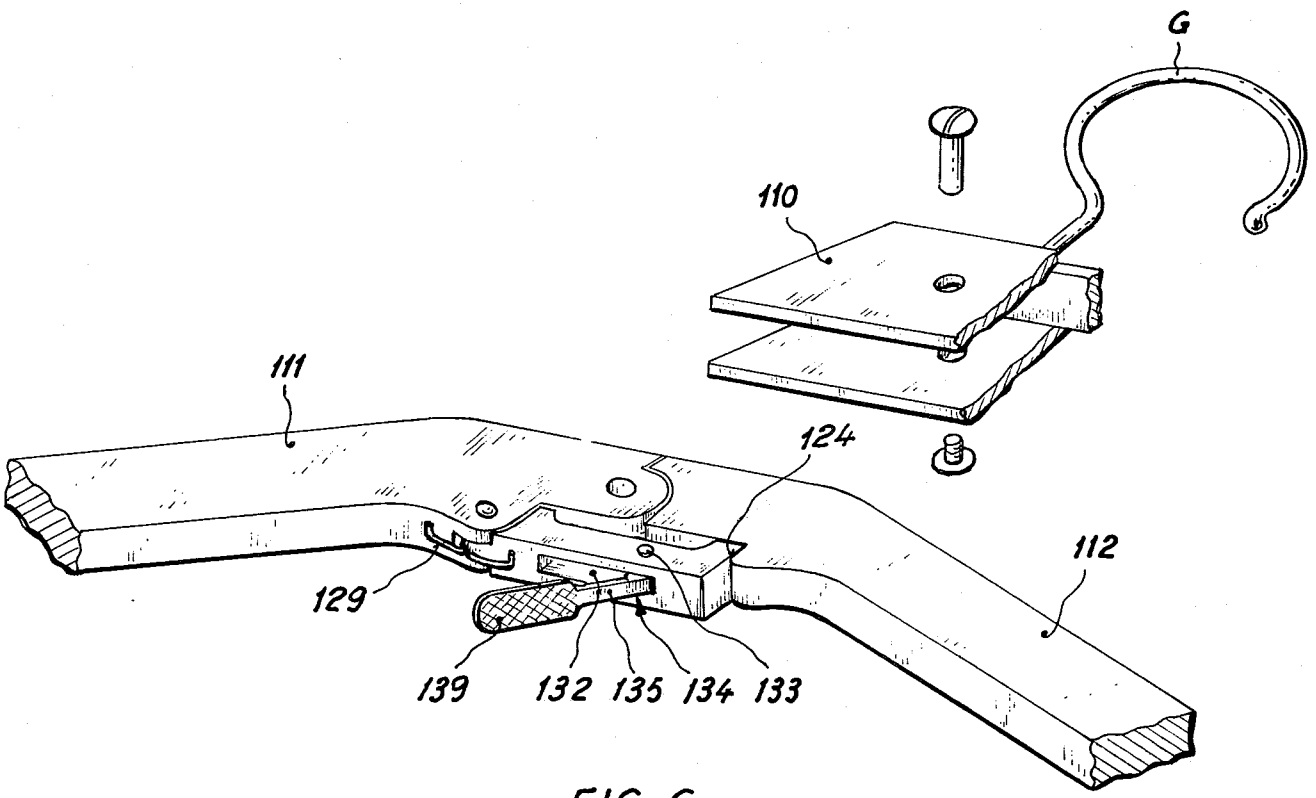
FIG. 6 is a similar view of a third embodiment of the invention.
Figure 7:
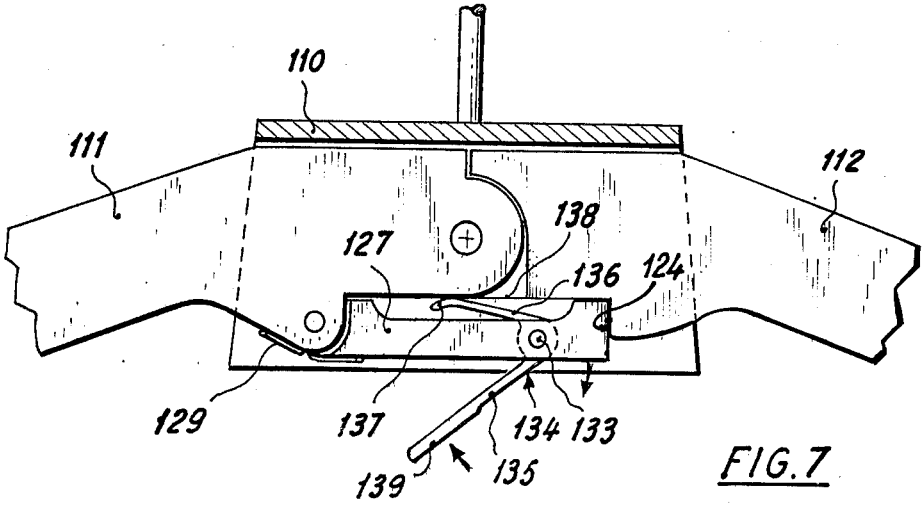
FIG. 7 is an elevation, partly sectional view, of the hanger of FIG. 6 in the extended condition.
Figure 8:
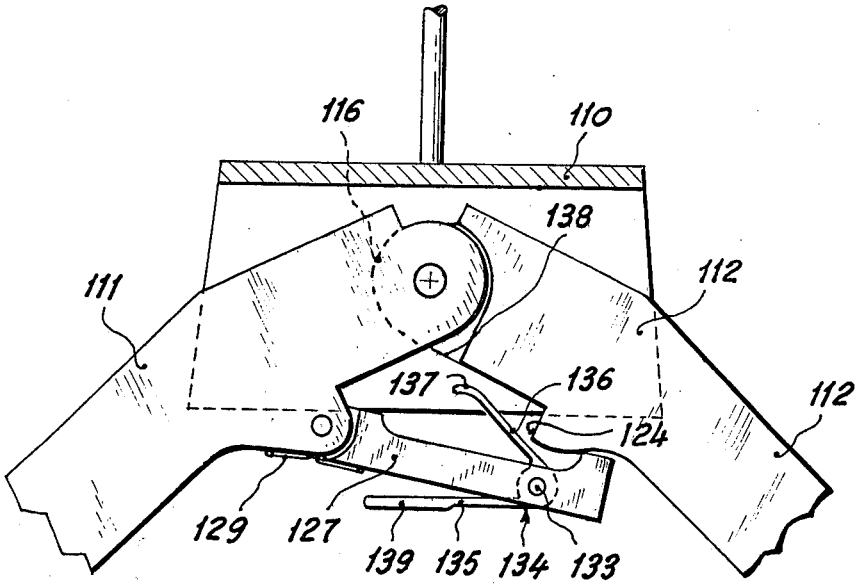
FIG. 8 is a similar view of the hanger of FIG. 6 in the folded condition.

FIGS. 6 to 8 show a hanger with a different release and locking mechanism, which hanger is not provided with the cord and is particularly suitable to be used in cinema and theatre cloakrooms and the like, where the hangers are hung at hand.

In this hanger, the release and locking mechanism is operated by means of a push member such as a lever or a push-button.

Member 127 is provided with a narrow slot 132 wherein a V-shaped lever member 134 is pivoted through a pin 133, lever member 134 having a lower branch 135 extending below member 127 and an upper branch 136 (FIGS. 7 and 8), the end 137 of which abuts against a lower straight edge 138 of end 116 of arm 112.

With such an arrangement of the parts, depressing knurled end 139 of arm 135 will cause lever member 134 to swing clockwise and upper branch 136 thereof to abut against edge 138. This will cause member 127 to rotate downward and disengage from lower rearward step 124, thus unlocking arms 111 and 112 supported by slotted block 110, which arms will swing down, to the folded position, under the weight of the garment, as shown in FIG. 2. Once the garment is clear of the hanger, arms 111 and 112 will be caused to rotate upwards to the raised position under the action of spring 129, as described above.

Figure 9:
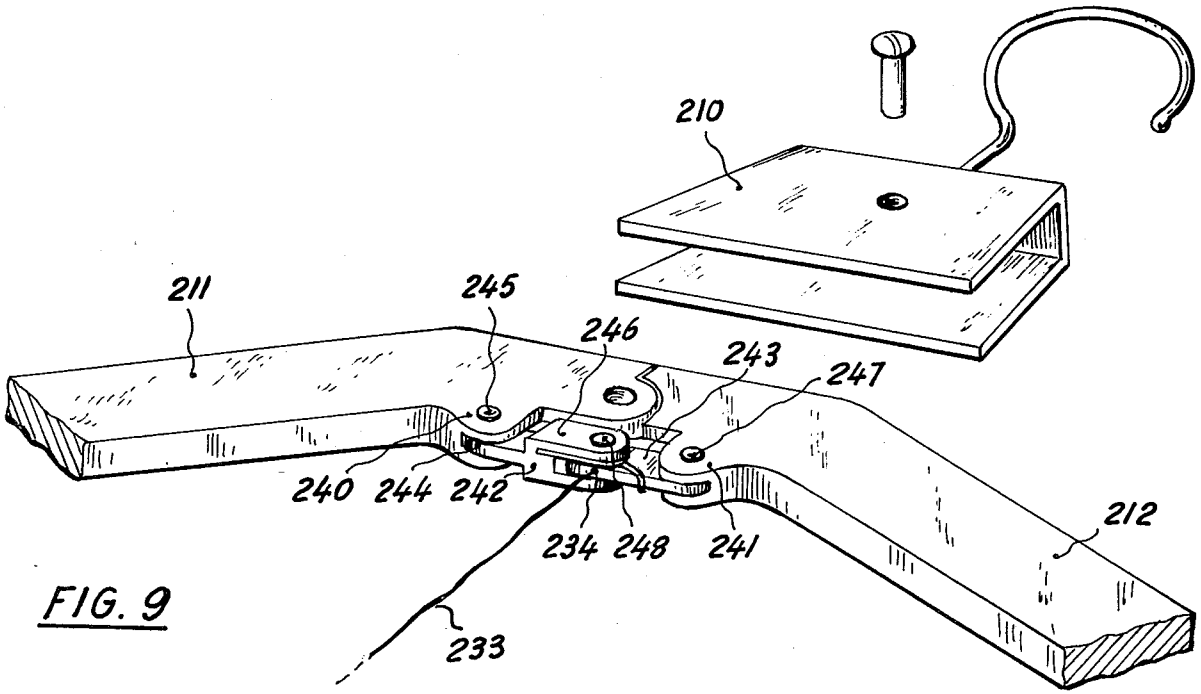
FIG. 9 is an exploded perspective view, with parts cut away or omitted, of a fourth embodiment of the invention.
Figure 10:
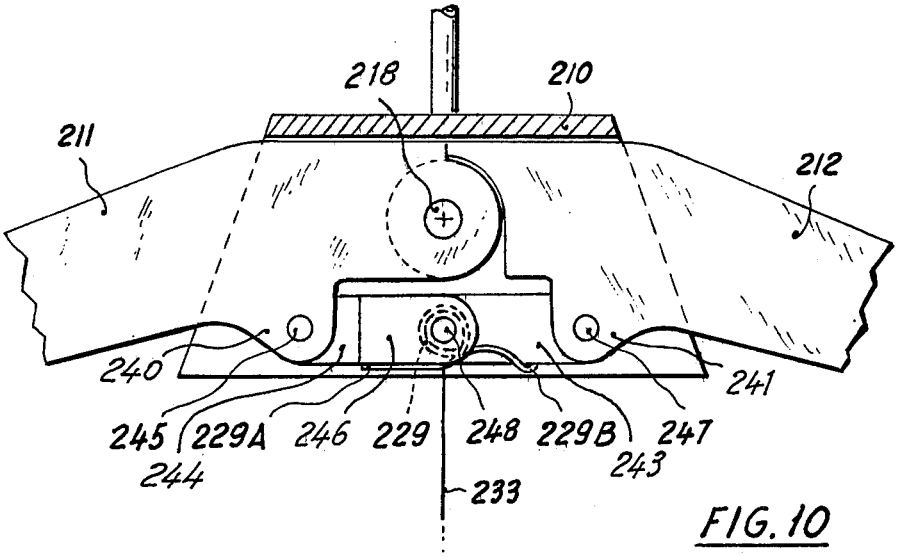
FIG. 10 is an elevation, partly sectional view of the hanger of FIG. 9 in the extended condition.
Figure 11:
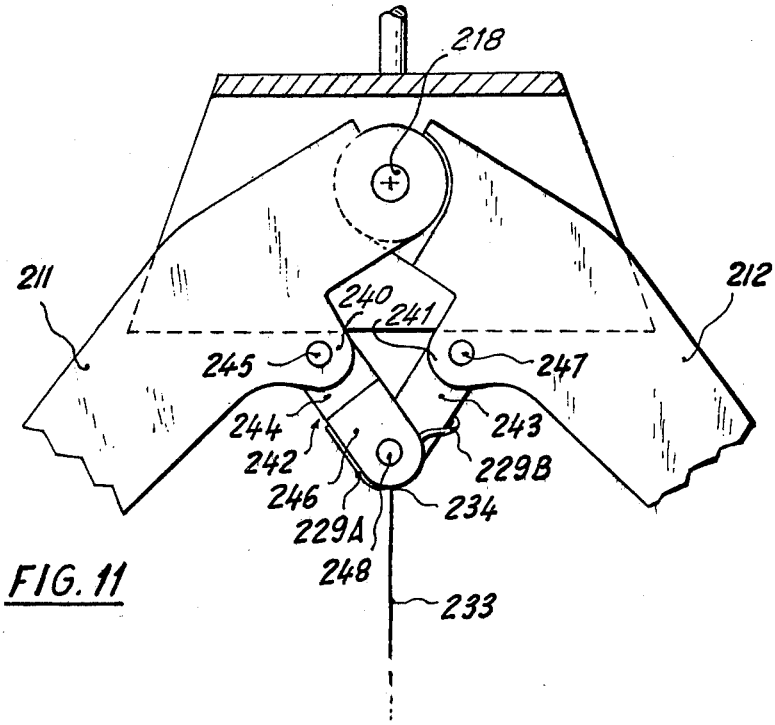
FIG. 11 is a similar view of the hanger of FIG. 9 in the folded condition.

FIGS. 9 to 11 show a hanger with collapsible arms provided with a different release and locking mechanism.

Firstly arms 211 and 212 are each provided with a lower protruding part 240 and 241, respectively, this part being slotted and suitably drilled, while the mechanism comprises two links 242 and 243 linked together at the inner ends thereof. Left end 244 of link 242 is pivoted on the groove of protruding part 240 through pin 245 and inner end 246 thereof is slotted, while link 243 is a simple link. The right end of simple link 243 is pivoted on protruding part 241 though pin 247 and the inner end thereof is linked with slotted end 246 of link 242 through pin 248.

The mechanism of this embodiment finally comprises a cord 233 fixed to link 243 at 234 and a coil torsion spring 229 fitted on pin 248. Arm 229A of spring 229 acts on the lower side of link 242 and the suitably curved arm 229B thereof acts on the lower side of link 243 so as to swing the two links to the extended position shown in FIG. 10. Thus, they are aligned and hold arms 211 and 212 of the hanger in the extended; raised position, the arms being pivotally mounted on slotted supporting block 210.

It is evident that on cord 233 being pulled, links 242 and 243 swing about pin 248 against the action of spring 229. Then, arms 211 and 212 swing downwards to the position illustrated in FIG. 11 under the weight of the garment which is thus allowed to slide off the hanger while, once the garment is clear of the hanger, spring 299 forces the arms to rise to the extended position.

Figure 12:
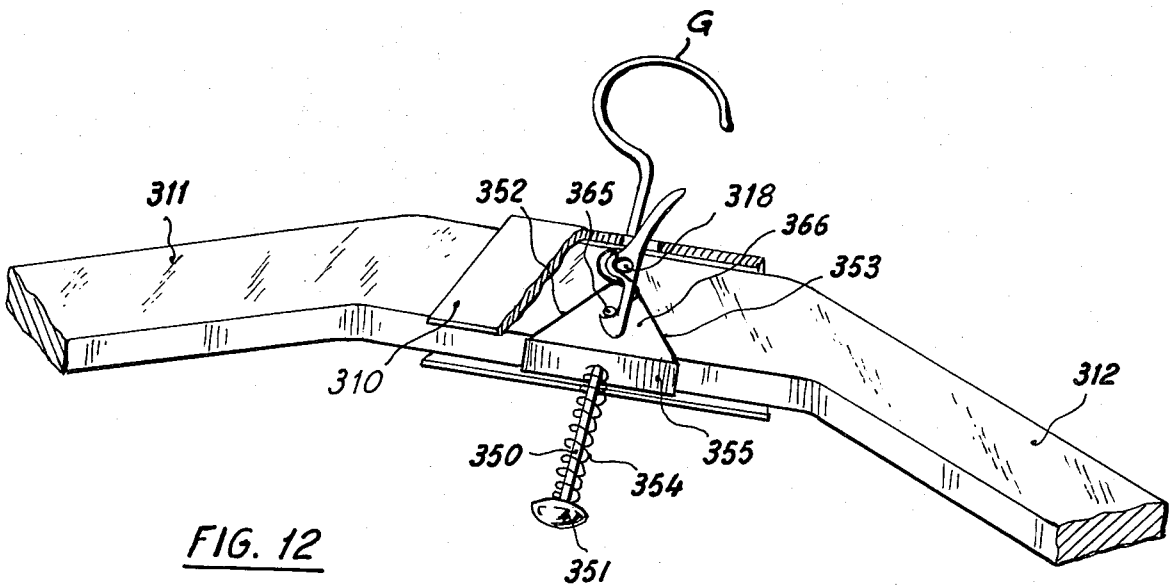
FIG. 12 is a perspective view, with parts cut away or omitted, of a fifth embodiment of the invention.
Figure 13:
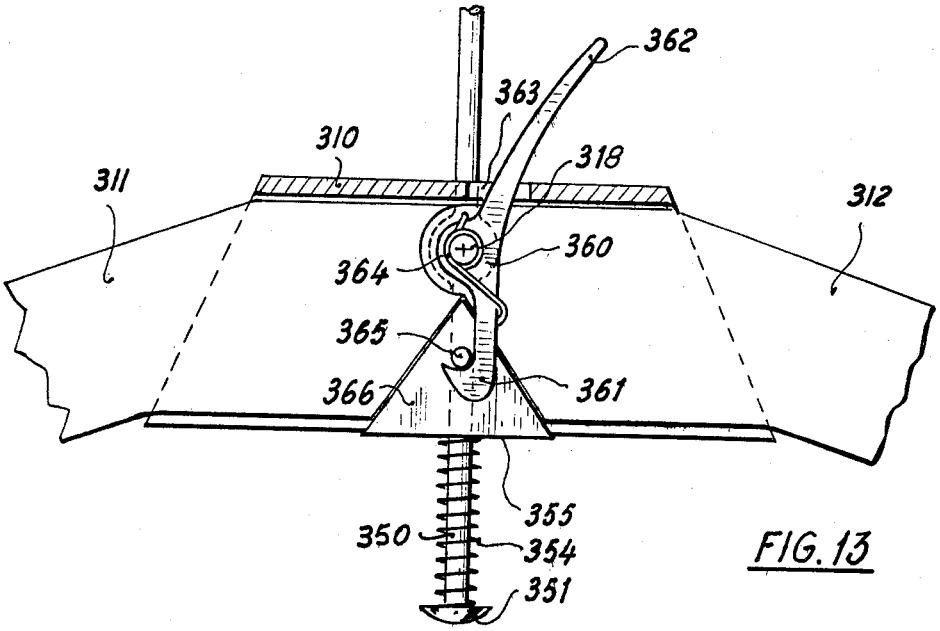
FIG. 13 is an elevation, partly sectional view of the hanger of FIG. 12 in the extended condition.
Figure 14:
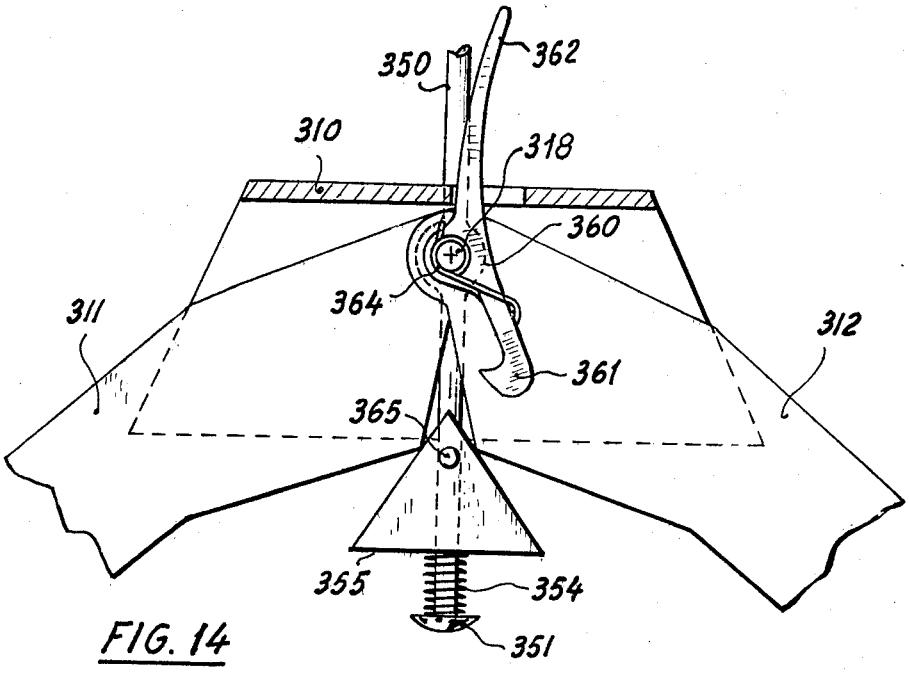
FIG. 14 is a similar view of the hanger of FIG. 12 in the folded condition.

FIGS. 12 to 14 show a last embodiment of the invention, wherein the release and locking mechanism includes a vertically sliding wedge element.

In this embodiment, stem 350 of hook G of the hanger extend downward through slotted block 310 and the pivoted ends of arms 311 and 312 have a vertical length ending with an enlarged head 351 below block 310.

Accordingly, each arm 311 and 312 has an outwardly sloped face, 352 and 353 respectively, below the pivoting member, that is pin or pivot 320, which faces form together an isosceles dihedral.

Moreover, a coiled compression spring 354 is fitted about stem 350 above head 351 and a wedge element 355 is slidingly fitted above spring 354. Wedge element 355 is shaped as a section of a right prism with isosceles triangular cross-section, identical with the dihedral formed by the faces 352 and 353 and, when mounted, spring 354 forces wedge element 355 against these faces.

Finally, a hook element 360 is pivoted on pin 318 within slotted supporting block 310 and externally of the pivoted ends of arms 311 and 312. Hook element 360 has a lower hook-shaped head 361 and an upper operating end 362 protruding outward of slotted block 310 through an elongated slot 363 formed thereon.

Hook-shaped head 361 is forced leftward in the Figure by coil torsion spring 364 to hook a pin 365 outwardly extending from outer face 366 of wedge element 355.

With such an arrangement, the loaded hanger remains in the extended position illustrated in FIG. 13 only owing to the action of head 361 of element 360 which hooks pin 365, under the action exerted upward by spring 354 on wedge element 355 which is not sufficient to oppose the downward directed force exerted by the garment on arms 311 and 312.

It will then be sufficient to press upper end 362 of hook element 360 to cause head 361 to release pin 365 so that the weight of the garment causes arms 311 and 312 to swing down and wedge element 355 to descend along stem 350 against the action of spring 354. However, the action of this spring will be sufficient to raise again wedge element 355 against sloped faces 352 and 353, once the garment is removed from the hanger.

Thus, the hanger automatically swings to the extended, raised position illustrated in FIG. 13 and is ready to support the weight of another garment, hook-shaped head 361 having automatically engaged again with pin 365.

In connection with this embodiment, it is useful to point out that, preferably, lower part 350 of stem G has a rectangular cross-section. And hole 367 of element 355 which receives stem 350 has a corresponding cross-section to avoid any rotational movement of element 355 in respect to collapsible arms 311 and 312.

It is evident from the above description that the hanger subject of the present invention is very useful and practical in all the cases where the garment placed on it must be rapidly removed.

In this regard, a further application of the hanger in question is in cinema and theatre cloakrooms and the like where, at the end of the performance, a large number of garments hung on the corresponding hanger have to be removed rapidly. In fact, it is very convenient, even when the hangers are at hand, to remove the garment therefrom by operating the release mechanism instead of inclining the hanger and taking it from the supporting rod, particularly since in cloakrooms of this kind the hangers are always very close to one another.

I claim:

1. A collapsible garment hanger comprising:

a mounting block having a supporting hook;

a pair of arms pivoted to said block for pivotal movement between a first positon wherein said arms are oppositely laterally directed from said block for supporting a garment and a second position extending downwardly from said block to permit a garment to drop therefrom;

interengageable abutments on said arms for limiting relative pivotal movement thereof to said first position;

a spring operated release and locking mechanism extending between said arms for urging said arms to said first position and locking the same in said first position;

manually operable means connected to said mechanism for releasing said arms to drop to said second position;

said mechanism comprising a lever pivoted to one of said arms and having a free end portion bearing on the underside of the other arm, a torsion coil spring urging said free end against said other arm, the free end portion of said lever engaging a shoulder on said other arm when said arms are in said first position to thereby lock said arms, said manually operable means being connected to said lever for swinging the same against the action of said spring;

said free end portion of said lever comprising an upwardly extending projection and said underside of said other arm comprises a cam surface adjacent said shoulder and oblique to the longitudinal axis of said other arm; and said manually operable means comprising a bell-crank pivoted at its apex within a slot in said lever and having one leg bearing on said one arm and the other leg extending downwardly from said lever.

* * * * *